US009011095B2

(12) United States Patent
Parker et al.

(10) Patent No.: US 9,011,095 B2
(45) Date of Patent: Apr. 21, 2015

(54) LATCHING DEVICE FOR A PUMP HOUSING AND PUMP

(75) Inventors: Daniel Parker, Pfinztal (DE); Uwe Koegel, Kürnbach (DE); Wolfgang Weber, Eschwege (DE); Tobias Albert, Kraichtal (DE)

(73) Assignee: E. G. O. Elektro-Gerätebau GmbH, Oberderdingen (DE)

( * ) Notice: Subject to any disclaimer, the term of this patent is extended or adjusted under 35 U.S.C. 154(b) by 588 days.

(21) Appl. No.: 13/410,653

(22) Filed: Mar. 2, 2012

(65) Prior Publication Data

US 2012/0224959 A1 Sep. 6, 2012

(30) Foreign Application Priority Data

Mar. 4, 2011 (DE) ..... 10 2011 005 140

(51) Int. Cl.
*F04D 29/42* (2006.01)
*F04D 29/62* (2006.01)

(52) U.S. Cl.
CPC ..... *F04D 29/426* (2013.01); *F04D 29/628* (2013.01)

(58) Field of Classification Search
CPC ..... F04D 29/42
USPC ..... 415/214.1, 206; 417/423.14; 403/322.1, 403/324, 326, 329
See application file for complete search history.

(56) References Cited

U.S. PATENT DOCUMENTS 3,645,547 A 2/1972 Glover
4,466,754 A 8/1984 Poitier
4,599,042 A * 7/1986 Colliver ..... 415/204
5,281,092 A * 1/1994 Sullivan ..... 415/206
5,689,852 A * 11/1997 Svoboda et al. ..... 15/405
5,699,601 A 12/1997 Gilliam et al.
6,364,618 B1 4/2002 Moreno
8,376,884 B2 * 2/2013 Spaggiari ..... 474/184

(Continued)

FOREIGN PATENT DOCUMENTS

DE 20 2009 003 756 6/2009
EP 1 529 731 A1 3/1997
EP 0 761 984 A1 5/2005

OTHER PUBLICATIONS

European Search Report dated Jul. 25, 2014 in European Application No. 1215678.9.

(Continued)

*Primary Examiner* — Ninh H Nguyen
(74) *Attorney, Agent, or Firm* — Lee & Hayes, PLLC

(57) ABSTRACT

A latching device for a pump housing for production of a releasable latched connection between two housing parts has, on a first housing part, an elongate latching hook comprising a latching protrusion on the upper side and introduction chamfers on the upper side and on the underside. A latching opening is provided in the second housing part and comprises a latching tongue defining the latching opening outwardly, the latching protrusion abutting this latching tongue. An introduction web is arranged on the underside of the latching opening and comprises an introduction chamfer for the latching hook. Two securing tongues engage laterally in the latching opening and protrude via a free tongue end into the path of the latching hook when said latching hook is inserted into the latching opening. They prevent an undesired automatic release of the latched connection caused by movement of the latching hook in a downwards direction.

22 Claims, 4 Drawing Sheets

(56) References Cited

U.S. PATENT DOCUMENTS

| | | | |
|---|---|---|---|
| 2006/0099092 | A1 | 5/2006 | Lu et al. |
| 2007/0086903 | A1 | 4/2007 | Schopperle et al. |
| 2007/0199933 | A1 | 8/2007 | Salice |
| 2010/0126534 | A1 | 5/2010 | Büsing et al. |

OTHER PUBLICATIONS

German Office Action dated Feb. 24, 2012 in DE 10 2011 005 140.6 (Mar. 4, 2011).
German Office Action dated Jan. 30, 2013 in DE 10 2011 005 140.6 (Mar. 4, 2011).

* cited by examiner

LATCHING DEVICE FOR A PUMP HOUSING AND PUMP

FILED OF APPLICATION AND PRIOR ART

The invention relates to a latching device for a pump housing for connecting releasably two housing parts of the pump housing by means of a latched connection. The invention also relates to a corresponding pump.

It is known from EP 2150165 A2 to produce a pump for dishwashers or washing machines, said pump comprising a housing made of plastic. A first housing part basically contains the upper part of the pump chamber. A second housing part basically contains the impeller with a pump chamber base and possibly a flange-mounted pump motor. By connecting these two housing parts, the pump housing, and thus the pump also, is completed as a substantially final assembly step for the pump. So as to quickly reach the functional parts of the pump in the event of repair, it is advantageous if the housing parts can be released again and then interconnected again. Releasable latched connections are considered to be particularly preferred in this instance.

OBJECT AND SOLUTION

The object of the invention is to create a latching device of the type mentioned at the outset for a pump housing and to create a pump comprising such a pump housing, with which problems of the prior art can be avoided and, in particular, a latched connection which is advantageously to be produced and released again can be created.

This object is achieved by a latching device having the features of Claims 1 and 16 and by a pump having the features of Claim 20. Advantageous and preferred embodiments of the invention are contained in the other claims and will be explained hereinafter. Some of the features mentioned below are mentioned only for a latching device or only for the pump. However, they can apply merely to the latching device or merely to the pump, irrespectively of this. The claims are worded with express reference to the content of the description.

The latching device has at least one elongate protruding latching hook on a first housing part. On its upper side, this latching hook has a latching protrusion, which can be formed virtually at right angles to the direction of insertion or alternatively can even be undercut. Furthermore, the latching hook has introduction chamfers both on its upper side and on its underside so that it is advantageously tapered in a forwards direction. A latching opening is provided in the second housing part for the latching hook and comprises a latching tongue defining the latching opening outwardly. The latching protrusion of the latching hook abuts this latching tongue when the latched connection is produced. The latching opening is thus a closed or bordered opening, wherein it is defined towards its underside substantially by the second housing part and towards its upper side by the aforementioned latching tongue, side walls of the latching opening being located between said upper and undersides.

In a first basic embodiment of the invention, an introduction web is arranged in the latching opening on the underside thereof opposite the latching tongue and has an introduction chamfer for the latching hook, wherein the introduction chamfer points towards the latching hook to be introduced. Furthermore, at least one securing tongue is provided which engages or runs into the latching opening from the side, in particular arranged or molded integrally on one of the aforementioned side walls. A free end of said tongue protrudes into the path of the latching hook as said latching hook is inserted into the latching opening. When the latched connection is produced, the securing tongue or the free end thereof is arranged beneath the latching hook or the underside thereof.

The introduction web, together with its introduction chamfer, is used to trap in good time, in the region of the latching opening, the latching hook to be inserted and to steer it to a certain extent in the direction in which it is then to be latched against the latching tongue. The introduction chamfer facilitates the introduction process in a known manner. Furthermore, the introduction web is to prevent excessive bending when the latching hook is pressed down so as to release the latched connection or the latching protrusion from the latching tongue, which could damage either the latching hook itself or other parts, in particular a securing tongue.

As a result of its resilient design at the underside of the latching hook or in the vicinity of this underside, the securing tongue is used to prevent automatic release of the latched connection, that is to say of the latching protrusion from the latching tongue. In this case, the underside of the latching hook would press against the free tongue end and would counteract the resilience of the securing tongue. Even if a bias of the latching hook such that the latching protrusion presses behind the latching tongue were omitted, a safeguard against automatic undesired release of the latched connection would still be provided.

In a further embodiment of the invention, a clear height between an upper side of the introduction web, in particular at the uppermost point thereof, and the latching tongue or the lower face thereof can be at most 10% to 30% greater than the clear cross section of the latching hook. This means, since the introduction web and latching tongue are to be considered as rigid parts, that a specific introduction space is indeed provided for the latching hook for simple and secure production of the latched connection. At the same time however, this space is not too large. These considerations apply above all when viewed in the longitudinal direction of the latching hook or in the direction of insertion.

The introduction web is advantageously arranged centrally in the latching opening on the underside thereof. The latching hook is just as advantageously also arranged centrally. The introduction web may be relatively narrow since it only has to take up compressive force, and the latching hook can be a number of times wider.

In an advantageous embodiment of the invention, the latching hook is provided on an elongate latching arm, more specifically at the free end thereof. The latching hook and latching arm have the same direction of extension. The latching arm is advantageously longer than the latching hook, particularly advantageously between twice and five times as long. It can be formed elastically in the direction between the upper side and underside of the latching opening as a result of a flat, wide cross section, so that the latching movement of the latching protrusion behind the latching tongue is just as easily possible as a release of the latched connection. By contrast, the latching arm is relatively rigid and stable against lateral movements, and it is therefore ensured that the latching hook is also introduced into the latching opening when the two housing parts are joined together. The aforementioned elasticity is ensured due to such an elongate latching arm comprising the latching hook thereon. Furthermore, the two housing parts can then potentially overlap generously, for example so as to provide a sealing connection.

In one embodiment of the invention, the latching protrusion of the latching hook or an undercut thereon can protrude beyond the cross section of the latching arm towards the upper side of the latching opening. An overhang may be a few mm in this instance for a secure latched connection, for example 2 mm to 5 mm. The introduction chamfer on the upper side of the latching hook runs from the highest point of the latching protrusion to an aforementioned tip of the latching hook, advantageously approximately in a straight line. A less pronounced and shorter introduction chamfer is formed on the underside of the latching hook, since there is also no latching protrusion provided here.

The securing tongue advantageously projects from the side or a side wall of the latching opening, particularly advantageously in the vicinity of the underside of the latching opening. The thickness of said securing tongue may reduce towards the end so that an optimal cross section with a uniform and material-compatible bending line can be achieved for elastic bending or deformation in the direction from the upper side of the latching opening to the underside. It is possible to bend the securing tongue at its free end increasingly upwards towards the latching tongue so that it initially runs approximately parallel to the underside of the latching opening and is then bent increasingly upwards. This also improves its desired spring properties. When the latched connection has been produced, the securing tongue may advantageously lie with its free end against the underside of the latching hook or may reach just before this point.

In a further embodiment of the invention it is possible for the clear width between the underside of the latching tongue and the free end of the securing tongue to be smaller than the clear cross section of the latching hook at its point of greatest thickness at the latching protrusion. This means that, when the latching hook is inserted into the latching opening, the underside of said hook is always pressed against the free end of the securing tongue and has to press it downwards so as to be inserted until it can engage with the latching protrusion behind the latching tongue. This also means that, to release the latched connection, the latching hook must press the securing tongue or the free end thereof downwards so that the latching protrusion can be released from the latching tongue, which is not possible without intervention. This is precisely the securing function of the securing tongue.

Two identical or mirror-symmetrical securing tongues are particularly advantageously provided both on a left-hand side and on a right-hand side of the latching opening. The free ends of said securing tongues may be distanced from one another so that they do not contact or interfere with one another. Above all, they may reach just before the introduction web and may be arranged higher than the introduction web. In this case, the introduction web also has another further function, because the underside of the latching hook presses the securing tongues downwards when the latched connection is released by pressing down on the latching hook. To ensure that the securing tongues are not pressed too far downwards, as a result of which they may become damaged, the latching hook then abuts the introduction web and can be withdrawn from the latching opening at the same time.

In a further embodiment of the invention, the securing tongue may initially taper in plan view, starting from an attachment at the base to the side wall of the latching opening, as a result of bevels on both side edges. The elasticity of said tongues can thus also be determined in detail. After approximately half its length, a securing tongue may have a hook-like widening and convexity on the side edge pointing towards the first housing part. Starting from this, it may narrow again towards the free tongue end. An introduction chamfer is formed towards the tongue end since, as has already been explained, in this case the chamfer is guided along the latching hook when said hook is inserted into said opening and presses it downwards. Furthermore, the securing tongue can be bent up towards the latching tongue from the region of the convexity.

The free end of the securing tongue is advantageously arranged slightly behind the introduction web in the direction of introduction of the latching hook into the latching opening. As a result, when producing the latched connection the latching hook can thus first be trapped and steered by the introduction web with its introduction chamfer. Further steering may then be taken over and implemented by the securing tongue or the free end thereof. There is thus a uniform expenditure of force when the latching hook is inserted.

In addition to the introduction web, elongate recesses or indentations may be provided on the underside of the latching hook to the left and right, that is to say at the sides, as cross sectional reductions of the latching hook. These recesses can be located over the connection areas between the securing tongues and a side wall of the latching opening. The advantage of these recesses is that, when pressed down to release the latched connection, the latching hook is only pressed against the elastic free tongue ends until its underside abuts the introduction web and, prior to this, does not press against the area of the securing tongues which is not elastic and which could be damaged.

In a further embodiment of the invention both the clear width between the underside of the latching tongue and the upper side of the introduction web as well as the arrangement of the securing tongues on side walls of the latching opening are formed in such a way that, if the latching hook is pressed against the upper side of the introduction web, these recesses extend in a planar manner above the areas of attachment of the securing tongues to the side walls of the latching opening.

In an advantageous embodiment of the invention, the latching hook has an approximately uniform width. It may be tapered slightly, merely right at the front at its end or tip, for easier introduction into the latching opening. The latching arm carrying the latching hook is advantageously of equal width over its length.

In a second basic embodiment of the invention, a latching device, as mentioned in principle at the outset, has an elastic or flexible spring means between the latching hook on the one hand and the latching tongue and/or the securing tongue on the other hand. This spring means can be rubber-like or an elastomer. The spring means is preferably an elastic or flexible coating. The latching hook thus only abuts the latching tongue via the spring means and there is no direct or rigid contact. Vibrations or other possible sources of noise can thus be dampened and are not transferred via the latching device from one housing part to the other, thus improving noise reduction.

The latching hook advantageously abuts the latching tongue in an axial direction, without direct contact of the otherwise rather firm and non-elastomeric materials of the housing parts, more specifically merely via the spring means. This is the primary introduction of force of the latched connection, which holds together the two housing parts, above all in the axial direction. The latching hook particularly advantageously also abuts the latching tongue in a radial direction, merely via a spring means, potentially via another spring means. The two parts can also thus be contacted elastically.

For example, the spring means can be applied to the latching hook as an elastic or flexible coating, for example by multi-component plastics injection molding. A thickness may be less than 3 mm, advantageously 1 mm or less. This is considered to be sufficient for noise reduction. The hardness of the elastomeric spring means may lie in a range of 50 to 70 Shore A.

In a development, a protrusion made of a non-elastic material can be provided in the spring means, as a result of which the thickness of the spring means is reduced. On the other hand, a type of stop limit is thus achieved so as to achieve a sufficiently defined contact between latching hook and latching tongue.

In another development, such a spring means can also be provided between the securing tongue and the latching hook. Similarly to the other spring means, this spring means may advantageously be provided on the corresponding side of the latching hook so that spring means or elastic coatings only have to be provided or overmolded on the latching hook.

The described latching device is particularly suitable for installation in a pump. The pump has a housing formed of at least two housing parts, which are to be connected. Indeed, more housing parts comprising such a latched connection can also be interconnected, for example by distributed latched connections. Precisely two housing parts are advantageously interconnected thereby, however.

These and further features will emerge not only from the claims, but also from the description and the drawings, wherein the individual features are implemented alone or together in the form of sub-combinations in an embodiment of the invention and in other fields and may constitute embodiments which are advantageous and patentable per se, for which protection is claimed here. The division of the application into individual sections and sub-headings does not limit the generality of the statements made herein.

BRIEF DESCRIPTION OF THE DRAWINGS

Exemplary embodiments of the invention are illustrated schematically in the drawings and are described in greater detail hereinafter. In the drawings.

DETAILED DESCRIPTION OF THE EXEMPLARY EMBODIMENTS

Figure 1:
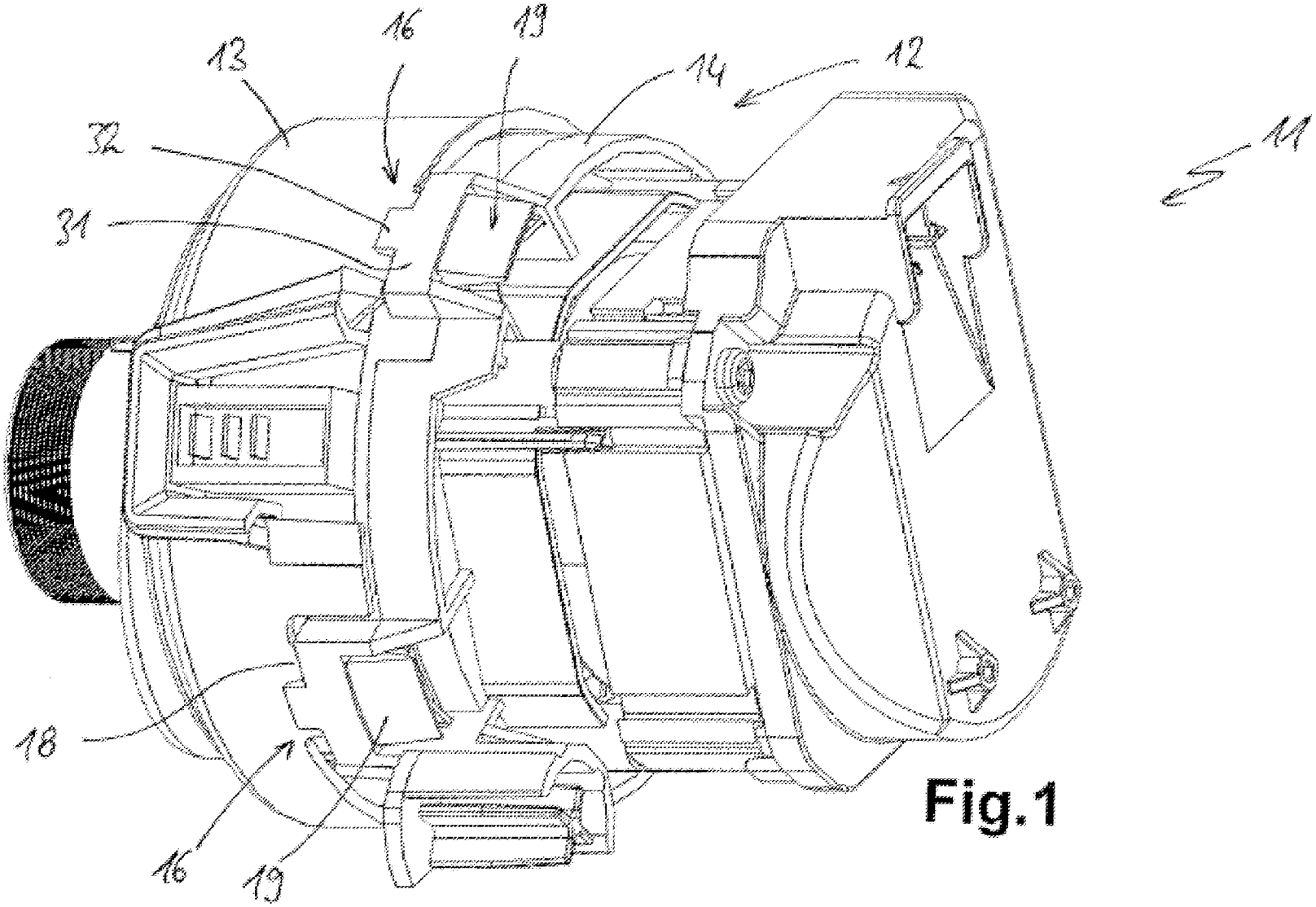
FIG. 1 shows an oblique external view of a pump comprising a pump housing and a plurality of latching devices.

With reference to FIG. 1, a pump 11 according to the invention is illustrated, comprising a pump housing 12, which has a first housing part 13 and a second housing part 14. The two housing parts 13 and 14 are made of plastic and are interconnected in a releasable manner by means of a plurality of latching devices 16. As can also be seen in particular together with FIGS. 2 and 3, four latching arms 18 comprising latching hooks 19 on the ends thereof are provided on the first housing part 13 for the latching devices 16. The latching arms 18 are of different length in part, but the latching hooks 19 are each identical.

Figure 2:
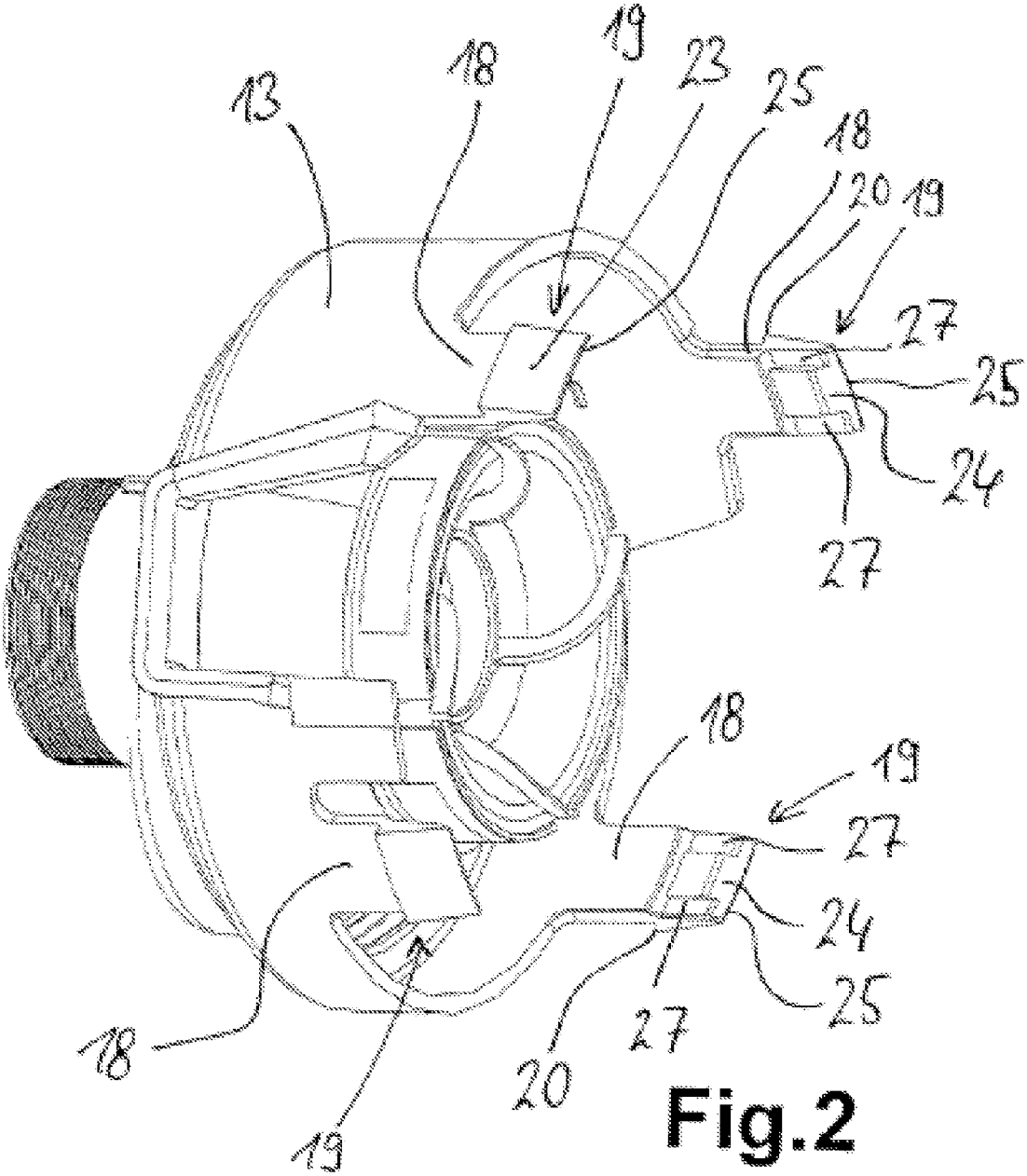
FIG. 2 shows an oblique view, corresponding to FIG. 1, of a first housing part of the pump comprising four projecting latching hooks.

On its upper side or outwardly, a latching hook 19 has a latching protrusion 20 comprising a slight undercut 21. The height of the latching protrusion 20 may be approximately double the thickness of the latching arm 18. An upper introduction chamfer 23 runs in a forwards direction from the latching protrusion 20 to a tip 25 of the latching hook 19. A lower introduction chamfer 24 is provided on the underside, but is much shorter. Furthermore, two lateral recesses 27 are provided in the underside of the latching hook 19 as indentations. Their function will be explained in greater detail further below. However, as shown in FIG. 2, they are only provided at the outer edge. Furthermore and as shown in FIG. 3 in a sectional view from the side, the latching hook 19 can be a small piece offset outwardly compared to the latching arm 18.

Figure 3:
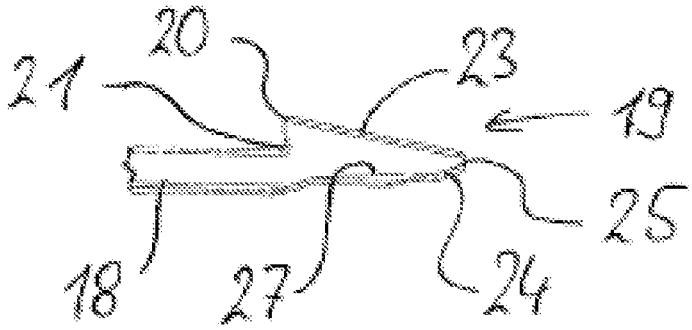
FIG. 3 shows a sectional view from the side of a latching hook according to FIG. 2.

Furthermore, it can be seen clearly from FIG. 2 that the latching arms 18 comprising the latching hooks 19 have a certain level of elasticity, which is provided upwardly and downwardly in the illustration according to FIG. 3. The relatively large width of the latching arms 18 counteracts undesired, lateral movement, that is to say movement perpendicular to the drawing plane in FIG. 3.

Figure 4:
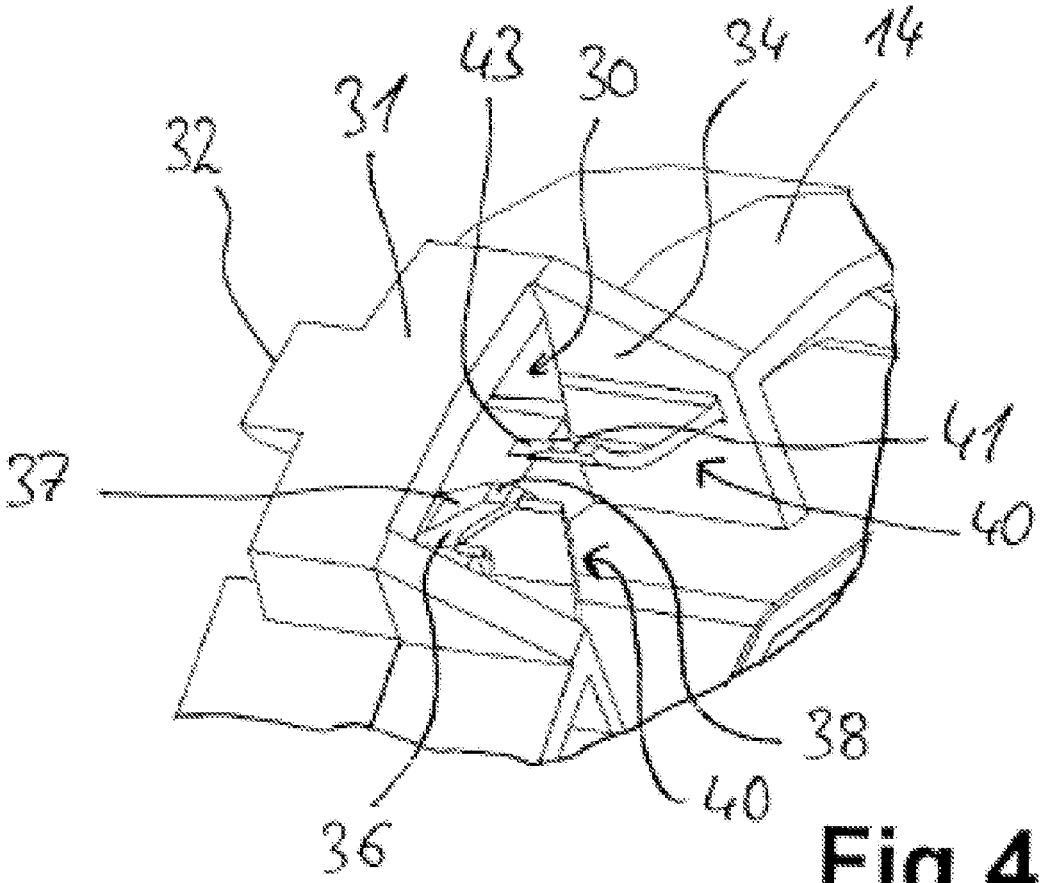
FIG. 4 shows an oblique view, corresponding to FIG. 1, of a latching opening in a second housing part.

With reference to FIG. 4, the other part of the latching device 16, namely a latching opening 30 comprising a latching tongue 31 defining and covering said opening upwardly in the manner of an overlapping, bridge-like web, is illustrated in the second housing part 14. An introduction protrusion 32 projects from the latching tongue 31 in the direction of the first housing part 13, that is to say from where the latching hook 19 is placed in position, and is beveled on its underside. The purpose of this is easier introduction, analogously to the upper introduction chamfer 23 of the latching hook 19.

Figure 7:
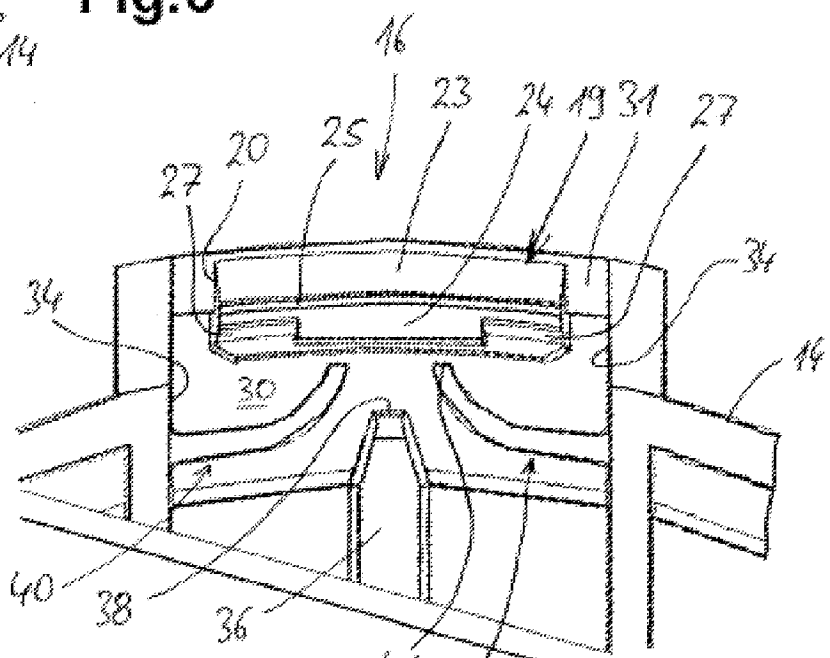
FIG. 7 shows a view from the front of the latching device of FIG. 6.
Figure 6:
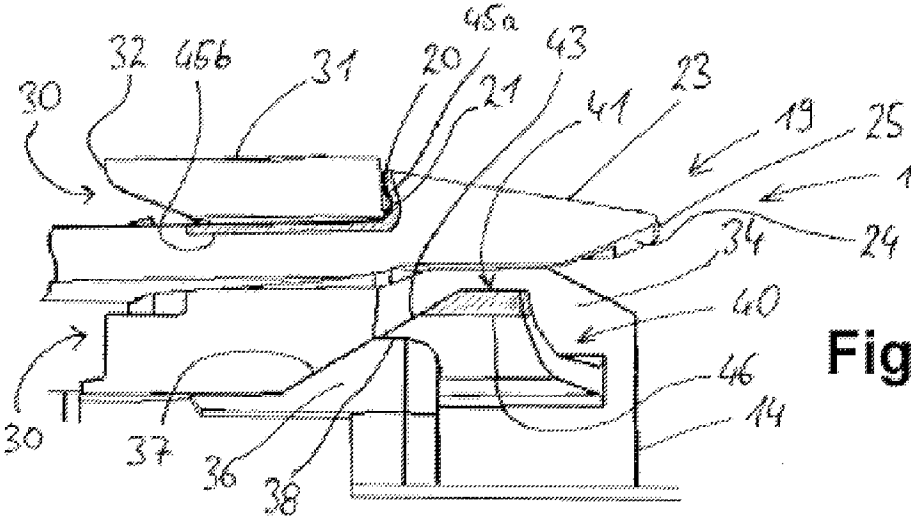
FIG. 6 shows a sectional view from the side, corresponding to FIG. 3, through the latching device with the latching hook of the first housing part in the latching opening in the second housing part.
Figure 5:
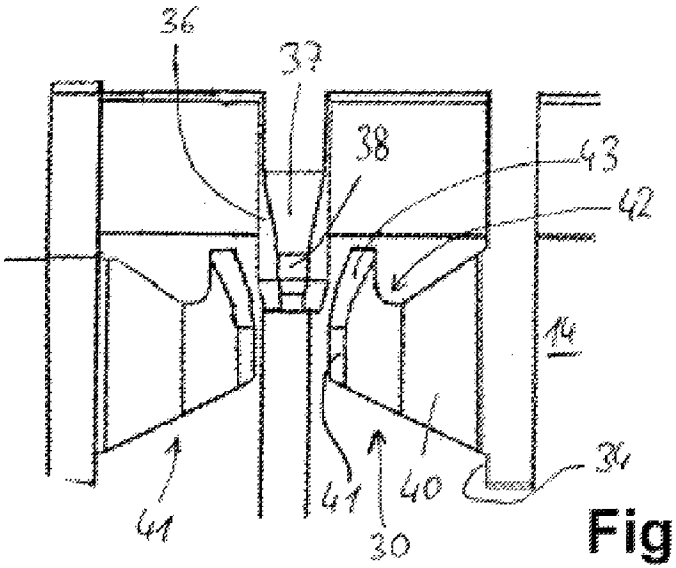
FIG. 5 shows a plan view of an introduction web and securing tongues in a latching opening in the second housing part, similar to FIG. 4.

As is also shown by comparison with FIGS. 5 to 7, the latching opening 30 is relatively large towards the first housing part 13, wherein it has a uniform width in accordance with FIG. 7 and only changes in terms of clear or free height between two side walls 34. An introduction web 36 is arranged oppositely on an underside of the latching opening 30 or of the latching tongue 31 in the middle of the latching opening 30. It has an introduction chamfer 37 in the direction towards the first housing part 13, said chamfer leading as far as an upper side 38 so that it has a type of ramp shape.

A securing tongue 40 projects from each side wall 34 into the latching opening 30 from the left and from the right of the introduction web 36. As is shown in particular in the plan view of FIG. 5, the securing tongues extend in a tapered manner from their area of attachment to the side wall 34 and narrow towards a convexity 42. This convexity 42 forms a hook-like widening towards the free tongue end 41. Another introduction chamfer 43 is provided towards the free tongue end 41 and can be seen particularly clearly in FIGS. 5 and 6.

As can be seen above all from FIGS. 6 and 7, which are relevant in this regard, the latching hook 19 in FIG. 6 is introduced from the left-hand side into the latching opening 30 when the two housing parts 13 and 14 are placed against one another. The latching opening is relatively large so that it can be easily located. The latching hook 19 on the latching arm 18, which is shown in FIG. 6 practically in its original state corresponding to FIG. 2 and thus only abuts the underside of the latching tongue 31 with a low level of elastic pressure, is pressed or guided towards the underside of the latching opening 30 by sliding its upper introduction chamfer 23 against the lower introduction chamfer of the introduction protrusion 32. For example, in the case of manual assembly by pressing down on the latching hook 19, said latching hook will be pressed very far downwards and its lower introduction chamfer 24 will run against the introduction chamfer 37 of the introduction web 36. The latching hook 19 will thus then be pressed upwards again.

As can be seen from FIG. 6, the side edge, pointing to the left, of the securing tongue 40 comprising the introduction chamfer 43 practically forms a continuation of the introduction chamfer 37 of the introduction web 36 and presses the latching hook 19 slightly further upwards again. The latching hook comes to rest with the upper end of the latching protrusion 20 abutting the underside of the latching tongue 31. Because it cannot press the latching tongue upwards, the securing tongue 40 is instead pressed downwards, which is not illustrated in FIGS. 6 and 7 but is easily conceivable. As soon as the latching protrusion 20 of the latching hook 19 has passed the latching tongue 31, the latching hook is either pressed upwards by its own resilience or by the resilience of the latching arm 18, or above all also by the resilience of the securing tongues 40. The latching protrusion 20 thus comes to rest, in a latched manner, against the edge of the latching tongue 31 pointing to the right or in a forwards direction, as illustrated in FIG. 6.

If, for whatever reason, the resilience of the latching arm 18, which presses the latching hook 19 upwards against the latching tongue 31, should then decrease or if the latching arm 18 should become deformed, the latching hook 19 can move in the direction of the underside of the latching opening 30, although admittedly only to a small extent. However, as shown in FIGS. 6 and 7, its underside very quickly abuts the free end 41 of the securing tongue 40 and is held by the resilience thereof. According to the figures, the distance between the underside of the latching hook 19 and the free tongue ends 41 is much smaller than the height of the latching protrusion 20, for example just under half the size. This means that the free tongue ends 41 and the securing tongues 40 would already have to be pressed downwards quite a way so that the latching protrusion 20 is freed from the latching tongue 31 to release the latched connection. Automatic release is thus reliably prevented. A latched connection produced in this manner also cannot be released automatically by vibrations occurring during operation of pumps.

Together with the curve bent towards the free tongue end 41, the cross section of the securing tongues 40 or their progression of thickness is designed specifically to provide sufficient resilience with a good level of elasticity against such an unintended release of the latched connection. The curved form means that the resilience of the securing tongues 40 when pressed down at the start is particularly high.

To release the latched connection of the latching device 16, the upper side of the latching hook 19 or the upper introduction chamfer 23 is pressed, for example by hand. This has to be carried out with sufficient force to bend the securing tongues 40 far enough downwards or to press the free tongue ends 41 far enough downwards that the latching protrusion 20 is freed from the latching tongue 31. However, the introduction web 36 inter alia is used in this case to prevent any damage to the securing tongues 40 as a result of being pressed excessively. The latching hook 19 then abuts the upper side 38 of the introduction web and cannot be pressed further downwards. This upper side can be used simultaneously as a perceptible stop so that a person carrying out assembly knows that they can now pull the latching hook 19 out from the latching opening 30.

It can be seen from FIG. 7 that the purpose of the recesses 27 in the underside of the latching hook 19 is that the latching hook 19 only presses against the free tongue ends 41 when it is pressed downwards against the introduction web 36, and is not pressed against the securing tongue 40 in the vicinity of the transition into the side wall 34. Such a deformation could not be taken up effectively by the elasticity of the securing tongues 40 and would lead to permanent damage.

The provision of two securing tongues leads to the advantage that, even in the event of mechanical failure of one securing tongue, the other securing tongue will still be able to perform its function. Due to the specific embodiment of the introduction chamfers, and in particular also of the securing tongues 40, a uniformly extending joining force can be achieved over the entire assembly path. There are thus no unwanted and undesirable peak loads when the two housing parts are fitted together.

Figure 8:
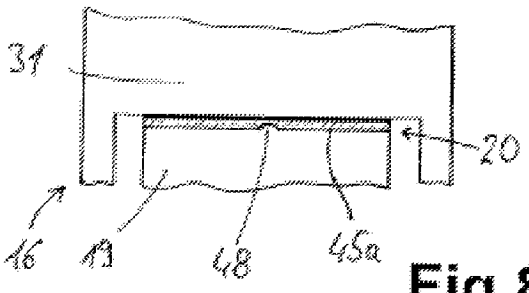
FIG. 8 shows a plan view of a detail of FIG. 6.

FIG. 6 further illustrates how a flexible coating 45*a* made of elastomeric material is provided on the side of the latching protrusion 20 pointing towards the latching tongue 31. This is also illustrated in FIG. 8 in a plan view of a partial detail of the latching device 16 corresponding to FIG. 6. The flexible coating 45*a* extends over the entire width of the latching hook 29 and of the latching protrusion 20. It takes over the aforementioned axial damping between the latching hook 19 and the latching tongue 31 and thus between the first housing part 13 and the second housing part 14.

It can be seen from FIG. 6 that resilient damping is also provided between a possible radial stop of the latching hook 19 against the latching tongue 31, namely as a flexible coating 45*b*. In the event of contact, vibrations can thus also be dampened here and a transfer of oscillations can be reduced.

As can be seen, the flexible coatings 45*a* and 45*b* are illustrated in a slightly hatched manner and are overmolded on the latching hook 19, which normally consists of hard plastics material and may be a thermoset or a thermoplastic, by a multi-component injection method using an elastomeric material. The thickness of the coatings may be approximately 1 mm to 2 mm. In principle, they can also both be provided on the latching tongue 31 or merely one of them can be provided on said latching tongue. Contiguous fabrication and application to the latching hook 19 are considered to be better and easier in terms of production, however.

Furthermore, it can be seen how the free ends of the securing tongues 40 also have a flexible coating 46 (illustrated in a hatched manner). The flexible coating 46 can be molded onto a slightly thinner core of the free tongue end 41 with a lower thickness than the other coatings, for example only 0.5 mm. Above all, the entire free tongue end 41 is therefore not flexible, but instead is only coated with a flexible coating. Lastly, said free tongue end is to take on the aforementioned securing function in a reliable manner. It is therefore important that the free tongue end 41 is substantially dimensionally stable.

It can also be seen from the plan view in FIG. 8 that a small stop protrusion 48 is provided on the latching hook 19 or on the latching protrusion 20 in the middle of the flexible coating 45*a*. This stop protrusion is advantageously a continuation of the hard material of the latching hook 19 or of the latching protrusion 20. The stop protrusion 48 is also still covered by the flexible coating 45*a* towards the latching tongue 31. However, the flexible coating 45*a* is quite clearly thinner in this instance, for example only 0.5 mm.

The stop protrusion 48 is used to press the latching protrusion 20 against the latching tongue 31 when an axial force is applied to pull apart the two housing parts 13 and 14 and thus compresses the elastomeric material of the flexible coating 45*a*. The stop protrusion 48 is provided as a limit stop so that this is not possible over the entire thickness of the coating 45*a*, which could result in excessive loosening of the two housing parts. The latching protrusion still abuts the latching tongue 31, however, as a result of the thinner coating 45*a* over a small area and can thus achieve a specific level of damping.

The invention claimed is:

1. A latching device for a multi-part pump housing for production of a releasable latched connection between a first housing part and a second housing part of the pump housing, the latching device comprising:

an elongate projecting latching hook on the first housing part, the latching hook including a latching protrusion on an upper side of the latching hook, and introduction chamfers on the upper side and on an underside of the latching hook; and a latching opening on the second housing part, the latching opening including a latching tongue defining the latching opening in an outward direction, the latching protrusion capable of abutting the latching tongue when the latched connection is completed, an introduction web located on an underside of the latching opening and opposite the latching tongue and having an introduction chamfer thereon for engaging the latching hook, and at least one securing tongue disposed on at least one side wall of the latching opening and protruding into the latching opening, and having a free end of the at least one securing tongue protruding into a path of the latching hook when the latching hook is inserted into the latching opening.

2. The latching device according to claim 1, wherein a distance between an upper side of the introduction web and the latching tongue is at most between 10% to 30% greater than a cross section distance of the latching hook.

3. The latching device according to claim 1, wherein the introduction web is arranged centrally in the latching opening on the underside thereof and also centrally to the latching hook.

4. The latching device according to claim 1, wherein the latching hook is formed on an elongate latching arm at a free end thereof and the latching hook and the latching arm have a same direction of extension.

5. The latching device according to claim 4, wherein the latching arm is between two to ten times as long as the latching hook and is elastically formed in a direction between the upper side and an underside of the latching opening as a result of a flat, wide cross section.

6. The latching device according to claim 1, wherein the latching protrusion of the latching hook extends on a distal end of the latching arm towards the upper side of the latching opening and an introduction chamfer extends from a highest point of the latching protrusion to a tip of the latching hook.

7. The latching device according to claim 1, wherein the at least one securing tongue projects from the at least one side wall of the latching opening and having a thickness that reduces towards a free tongue end, the at least one securing tongue being bent towards the free end increasingly upwards towards the latching tongue and one of engaging the free tongue end at a point on the underside of the latching hook, or reaching just before the point when the latched connection is produced.

8. The latching device according to claim 7, wherein a distance between the underside of the latching tongue and the free end of the at least one securing tongue is smaller than a cross section distance of the latching hook at its point of greatest thickness at the latching protrusion.

9. The latching device according to claim 1, wherein the at least one securing tongue comprises two symmetrically disposed securing tongues are provided on a left-hand side and on a right-hand side of the latching opening, the free ends of the two securing tongues having a distance from one another and extending immediately before the introduction web and protruding higher than the introduction web.

10. The latching device according to claim 1, wherein the at least one securing tongue initially tapers starting from an attachment at the base to the side wall of the latching opening, as a result of bevels on both side edges and then, after approximately half its length, having a hook-like widening and convexity on the side edge pointing towards the first housing part and narrows towards the free tongue end.

11. The latching device according to claim 10, wherein an introduction chamfer is formed on the at least one securing tongue towards the free tongue end, the at least one securing tongue being bent up towards the latching tongue from the convexity.

12. The latching device according to claim 1, wherein the free end of the at least one securing tongue is arranged slightly behind the introduction web in the direction of introduction of the latching hook into the latching opening.

13. The latching device according to claim 1, wherein, in addition to the introduction web, elongate recesses are provided in the underside of the latching hook to the left and right as cross sectional reductions of the latching hook, and these recesses are located over connection areas between the at least one securing tongue and a side wall of the latching opening.

14. The latching device according to claim 13, wherein a distance between the underside of the latching tongue and the upper side of the introduction web as well as the arrangement of the at least one securing tongue on a side wall of the latching opening are formed in such a way that, when the latching hook is pressed against the upper side of the introduction web, the recesses in the underside of the latching hook extend above the areas of attachment of the at least one securing tongue to the side walls of the latching opening and do not interfere therewith at this point.

15. The latching device according to claim 1, wherein the latching hook has an approximately uniform width, in particular also together with a latching arm extending from the latching hook.

16. A pump comprising a pump housing formed of at least two housing parts, wherein at least two housing parts are interconnected by means of a latching device according to claim 1.

17. The pump according to claim 16, wherein the pump housing has precisely two separate housing parts, which are interconnectable.

18. A latching device for a multi-part pump housing for the production of a releasable latched connection between a first and a second housing part of the pump housing, the latching device comprising:

an elongate projecting latching hook on the first housing part including a latching protrusion on the upper side of the latching hook and introduction chamfers on the upper side and on the underside;

a latching opening on the second housing part including a latching tongue defining the latching opening in an outward direction, where the latching protrusion being capable of abutting the latching tongue when the latched connection is completed; and an elastic spring means being arranged between the latching hook and at least one of the latching tongue or a securing tongue.

19. The latching device according to claim 18, wherein the latching hook abuts the latching tongue without direct contact and only via the spring means.

20. The latching device according to claim 18, wherein the latching hook abuts the latching tongue in an axial direction without direct contact and only via the spring means.

21. The latching device according to claim 18, wherein the spring means is one of an elastic or flexible coating, which is applied to at least one of the latching tongue or the securing tongue.

22. The latching device according to claim 21, wherein a protrusion made of a non-elastic material is provided in the spring means and reduces the thickness of the spring means.

* * * * *